US008857339B2

(12) United States Patent
Muller et al.

(10) Patent No.: US 8,857,339 B2
(45) Date of Patent: Oct. 14, 2014

(54) DETONATION OF EXPLOSIVES

(75) Inventors: Elmar Muller, Centurion (ZA); Pieter Stephanus Jacobus Halliday, Randburg (ZA); Clifford Gordon Morgan, Kempton Park (ZA); Paul Dastoor, Callaghan (AU); Warwick Belcher, Callaghan (AU); Xiaojing Zhou, Callaghan (AU); Glenn Bryant, Callaghan (AU)

(73) Assignee: AEL Mining Services Limited, Woodmead, Sandton (ZA)

( * ) Notice: Subject to any disclaimer, the term of this patent is extended or adjusted under 35 U.S.C. 154(b) by 11 days.

(21) Appl. No.: 13/992,794

(22) PCT Filed: Dec. 9, 2011

(86) PCT No.: PCT/IB2011/055576

§ 371 (c)(1),
(2), (4) Date: Jun. 10, 2013

(87) PCT Pub. No.: WO2012/077084

PCT Pub. Date: Jun. 14, 2012

(65) Prior Publication Data

US 2013/0255521 A1 Oct. 3, 2013

(30) Foreign Application Priority Data

Dec. 10, 2010 (ZA) ..... 2010/08925
Dec. 10, 2010 (ZA) ..... 2010/08927
Feb. 21, 2011 (ZA) ..... 2011/01370

(51) Int. Cl.
*F42C 15/38* (2006.01)
*F42C 19/12* (2006.01)

(Continued)

(52) U.S. Cl.
CPC ... *F42D 1/05* (2013.01); *C06C 5/06* (2013.01); *F42B 3/18* (2013.01); *F42C 19/12* (2013.01);

(Continued)

(58) Field of Classification Search
CPC ..... F42C 15/38; F42C 19/12; C06C 5/06; F42D 1/05; F42D 1/045; F42B 3/12; F42B 3/18; F42B 3/113
USPC ..... 102/200, 201, 202.1, 202.5, 202.7, 206, 102/215, 217, 218, 262, 301, 311, 312, 313, 102/314, 322
See application file for complete search history.

(56) References Cited

U.S. PATENT DOCUMENTS 3,837,282 A 9/1974 Morrow
4,020,765 A 5/1977 Glass et al.

(Continued)

FOREIGN PATENT DOCUMENTS

DE 195 46 823 6/1997
EP 0 207 749 1/1987

(Continued)

OTHER PUBLICATIONS

PCT/IB2011/055576 International Search Report dated May 23, 2012 (5 pages).

(Continued)

*Primary Examiner* — James Bergin
(74) *Attorney, Agent, or Firm* — Brinks Gilson & Lione; G. Peter Nichols

(57) ABSTRACT

An explosives detonator system for detonating an explosive charge with which it is, in use, arranged in a detonating relationship is provided. On acceptance of a detonation initiating signal having a detonation initiating property, the system initiates and thus detonates the explosive charge. The system includes an initiating device which accepts the detonation initiating signal and initiates and thus detonates the explosive charge. The initiating device is initially in a non-detonation initiating condition, in which it is not capable of accepting the detonation initiating signal. The system also includes a switching device that detects a chemical compositional component as a switching property of a switching signal that is transmitted to the detonator system, with the switching device being capable of switching the initiating device, on detection of the chemical compositional component, to a standby condition in which the initiating device accepts the detonation initiating signal when it is transmitted thereto.

35 Claims, 1 Drawing Sheet

(51) Int. Cl.

| | |
|---|---|
| ***F42B 3/12*** | (2006.01) |
| ***F42B 3/18*** | (2006.01) |
| ***F42B 3/113*** | (2006.01) |
| ***F42D 1/05*** | (2006.01) |
| ***C06C 5/06*** | (2006.01) |

(52) U.S. Cl.
CPC . *F42C 15/38* (2013.01); *F42B 3/12* (2013.01)
USPC ..... 102/206; 102/201; 102/202.7; 102/275.6; 102/262; 102/322

(56) References Cited

U.S. PATENT DOCUMENTS

| | | | | |
|---|---|---|---|---|
| 4,700,629 | A | 10/1987 | Benson et al. | |
| 4,869,171 | A | 9/1989 | Abouav | |
| 5,243,913 | A | 9/1993 | Brent et al. | |
| 5,435,249 | A | 7/1995 | Brent et al. | |
| 5,942,718 | A | 8/1999 | Falquete et al. | |
| 6,718,881 | B2 * | 4/2004 | Rauscher, Jr. | 102/217 |
| 6,802,260 | B2 * | 10/2004 | Woodall et al. | 102/408 |
| 2005/0178282 | A1 | 8/2005 | Brooks et al. | |
| 2008/0302264 | A1 | 12/2008 | Hummel et al. | |
| 2009/0193992 | A1 | 8/2009 | Moore | |
| 2013/0255520 | A1 * | 10/2013 | Muller et al. | 102/201 |
| 2013/0319276 | A1 * | 12/2013 | Muller et al. | 102/202.7 |

FOREIGN PATENT DOCUMENTS

| | | |
|---|---|---|
| WO | WO 97/01076 | 1/1997 |
| WO | WO 2006/096920 | 9/2006 |
| WO | WO 2006/128257 | 12/2006 |

OTHER PUBLICATIONS

PCT/IB2011/055573 International Search Report dated Apr. 2, 2012 (2 pages).
PCT/IB2011/055573 International Preliminary Report on Patentability dated Jun. 12, 2013 (7 pages).
PCT/IB2012/050757 International Search Report dated May 8, 2012 (2 pages).
U.S. Appl. No. 13/992,790, filed Jun. 10, 2013 entitled "Detonation of Explosives".
U.S. Appl. No. 13/985,705, filed Aug. 15, 2013 entitled "Detonation of Explosives".

* cited by examiner

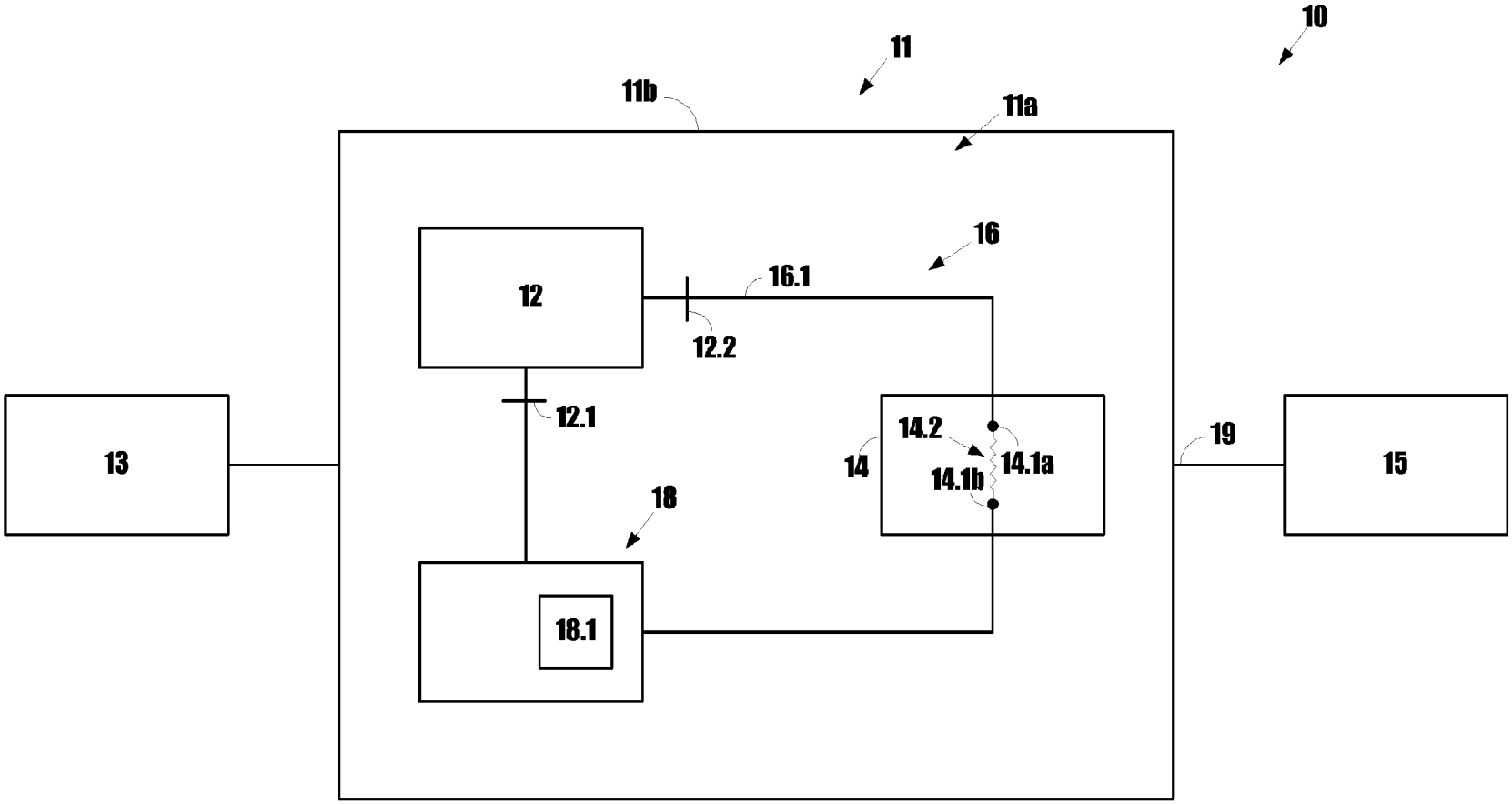
10
11
11a
11b
12
12.1
12.2
13
14
14.1a
14.1b
14.2
15
16
16.1
18
18.1
19

DETONATION OF EXPLOSIVES

This application claims priority to International Application No. PCT/IB2011/055576 filed Dec. 9, 2011; South African Application No. 2010/08925 filed Dec. 10, 2010; South African Application No. 2010/08927 filed Dec. 10, 2010; and South African Application No. 2011/01370 filed Feb. 21, 2011, the entire contents of each are incorporated herein by reference.

FIELD OF THE INVENTION

This invention relates to detonation of explosives. More particularly, the invention relates to detonator systems for detonating explosives with which they are arranged in a detonating relationship. The invention accordingly provides a detonator system for detonating an explosive charge with which it is, in use, arranged in a detonating relationship. The invention also provides a method of operating a detonator system. The invention further provides a shock tube.

BACKGROUND TO THE INVENTION

Detonation of explosive charges is generally effected by means of detonators which are provided in a detonating relationship with the explosive charges. Such explosive charges usually comprise so-called "main" or "secondary" explosives.

In the mining industry, in particular, as well as in a number of other industries which rely on the use of explosives, e.g. the demolition industry, accurate control of explosives detonation is of great importance, for reasons including safety and accuracy of blasting operation.

Generally speaking, one can distinguish between two types of detonators namely electronic detonators and pyrotechnic detonators.

Electronic detonators generally effect detonation of an explosive with which they are in a detonating relationship by generating a voltage spark or plasma in proximity to the explosive. Such voltage spark or plasma is generated by the breakdown of a resistive element or bridge which is provided between two conductive electrodes. The resistive bridge and the electrodes are generally referred to collectively as a "fuse head" which is accommodated within a detonator housing. The plasma generates a shock wave which is transmitted to the proximate explosive and initiates the explosive.

Such electronic detonators generally provide accurate control over detonation, particularly as regards timing and delay properties thereof. However, electronic detonators are expensive to manufacture and difficult to use usually also, requiring a separate or external power source and complex electronic transmission wire connections to allow transmission of electricity to the detonator and permit remote triggering thereof. In the applicant's experience, such detonator connections are prone to failure and may even result in premature initiation of the detonator and thus of the explosive, possible due to false stimuli, e.g. radio-frequency (RF) interference on the mining/demolition site.

In contrast to electronic detonators operating by means of an electronic delay system, pyrotechnic detonators employ a series of explosive charges that are located within a detonator housing to provide a desired detonating signal to the main explosive charge at a required timing and delay. The series of explosive charges generally includes (i) an initiating and sealing charge, also known as a priming charge, (ii) a timing charge, (iii) a primary charge and, optionally, (iv) a base charge. The initiating charge serves to initiate the explosive sequence in response to a shock signal transmitted thereto and also functions as a sealing charge which provides a seal to prevent blow-back inside the detonator housing. The initiating charge also initiates the timing charge which provides a desired burning delay for detonation. The timing charge, in turn, initiates the primary charge which either directly provides a detonation initiating signal to the main explosive charge, or initiates the base charge that, in turn, will provide the desired detonation initiating signal to the main explosive charge.

As alluded to above, initiation of the initiating charge of a pyrotechnic detonator is generally effected by imparting a shock signal to the detonator, typically being provided by one or more shock tubes which are located in an initiating relationship with the detonator. The initiating charge then typically comprises a sensitive explosive, initiation of which can be effected by a shock wave of sufficient magnitude. Shock tube is well known and widely used in the initiation of detonators; it comprises a hollow plastic tube lined with a layer of initiating or core explosive, typically comprising a mixture of HMX and aluminium metal powder. Upon ignition of the initiating (core) explosive, a small explosion propagates along the tube in the form of an advancing temperature/pressure wave front, typically at a rate of approximately 7000 ft/s (about 2000 m/s). Upon reaching the detonator, the pressure/temperature wave triggers or ignites the initiating/sealing charge in the detonator, which results in the sequence of ignitions mentioned above and thus eventually causing detonation of the main explosive charge. Although shock tube is economically attractive and easy to use, existing pyrotechnic-based detonator systems do not at all permit the same extent of control of detonation timing and delay which is achieved by using electronic detonators, as the timing and delay features are provided by the detonator explosive charge loading, instead of by electric components.

The present invention therefore seeks, broadly, to provide an approach to operating explosive detonators which addresses and at least partly alleviates the disadvantages associated with both pyrotechnic and electronic initiation of explosive detonators.

SUMMARY OF THE INVENTION

In accordance with a first aspect of the invention, there is provided an explosives detonator system for detonating an explosive charge with which it is, in use, arranged in a detonating relationship and which, on operative acceptance of a detonation initiating signal that has a detonation initiating property, is capable of initiating and thus detonating the explosive charge, the detonator system including

- an initiating device which is capable of accepting the detonation initiating signal and of initiating and thus detonating the explosive charge, the initiating device being in a non-detonation initiating condition in which it cannot operatively accept the detonation initiating signal and thus assume a detonator initiating condition when the detonation initiating signal is transmitted thereto; and
- a switching device that is capable of detecting a chemical compositional component as a switching property of a switching signal that is transmitted to the detonator system, with the switching device being capable of switching the initiating device, on detection of the chemical compositional component, to a standby condition in which the initiating device is capable of operatively accepting the detonation initiating signal when it is transmitted thereto.

For the purposes of continuity with the wording used in the specification of priority application number ZA 2010/08925, it is to be noted that the initiating device is, in effect, a trigger for a detonator and, in a sense, comprises a detonator. The switching device, in turn, is, in effect, a detector or sensor. Similarly, the switching property is a triggering property and the switching signal an initiating signal. Further differences in terminology between the specification of priority application number ZA 2010/08925 and the present specification will be apparent from the description that follows.

It will be appreciated that the presence of the chemical compositional component in the switching signal is therefore a prerequisite for the initiating device to become susceptible, by being switched into the standby condition, for being switched into the detonation initiating condition.

The switching signal may, in particular, be a shock signal which is provided by, and propagated along, shock tube. The system may then include shock tube that is arranged or provided in initiating proximity to the initiating device. The chemical compositional component may then, in particular, be provided by a product wave component of the shock signal, comprising product gases resulting from progressive detonation of an explosive substance contained in the shock tube. In one embodiment of the invention, the shock tube may contain a tracer compound, combustion of which, due to detonation of the explosive substance, releases a product gas that constitutes the chemical compositional component. Alternatively, the chemical compositional component may be a normal product gas of the explosive substance.

The shock tube may, in particular, be a shock tube as is hereinafter described, having a hollow elongate body, inside of which is provided a shock tube explosive, detonation of which provides the shock signal, as well as a tracer chemical, with the proviso that the tracer chemical is not, and on decomposition, combustion or detonation does not provide, a chemical that is the same as a combustion or detonation product of the shock tube explosive. The tracer chemical may, in particular, provide the chemical compositional component, either in itself or by reason of its own decomposition, combustion or detonation.

The initiating device may comprise an electronic detonation circuit which includes a primary conductive path having at least two spaced apart conductive electrodes between which a resistive bridge is provided. The electrodes may be connectable to a voltage source which, when the initiating device is in the standby condition, is capable of generating a detonation initiating voltage difference, as the detonation initiating property, between the electrodes, which voltage difference exceeds the breakdown voltage of the resistive bridge, thereby, in use in the detonation initiating condition, to cause the resistive bridge to generate a voltage spark or plasma capable of causing initiation and detonation of the explosive charge.

The switching device may, in particular, be a resistive component that is provided in the primary conductive path of the detonation circuit and provides, in the non-detonation initiating condition, resistance against conduction of current from the voltage source to the resistive bridge, such resistance being of sufficient magnitude that the detonation initiating voltage cannot, in use, be generated between the resistive electrodes for a given load that the voltage source is capable of applying.

More particularly, the switching device may have a variable conductance, with its conductance, in the non-detonation initiating condition, being of a magnitude that is non-conducive to generation of the detonation initiating voltage difference between the electrodes. The conductance of the switching device may then be sensitive to, and thus capable of being changed, in response to the chemical compositional component of the switching signal such that, in the standby condition, the conductance of the switching device is of a magnitude that is conducive to the generation of the detonation initiating voltage difference between the electrodes.

The switching device may, in particular, be a transistor. The transistor may then typically have a variable conductance, particularly a channel conductance, with its channel material, or another material forming part of the transistor, comprising a material that is sensitive, as a function of its conductance, to the chemical compositional property, as described in more detail hereinafter.

The switching signal may also include (i) a pressure component; (ii) a temperature component; and/or (iii) a light pulse. The switching signal may thus provide, as a switching property additional to the chemical compositional component, a switching pressure, a switching temperature, and/or a switching light pulse. In such a case, the switching device may thus also be capable of detecting the switching pressure, the switching temperature and/or the switching light pulse and thus of switching the initiating device to the standby condition on detection thereof. As in the case of detection by the transistor of the chemical compositional component and switching of the initiating device into the standby condition, may be by reason of a change in the conductance of a material of the transistor that is sensitive, as a function of its conductance, to at least one of the switching pressure, the switching temperature and/or the switching light pulse, as described in more detail hereinafter.

It will be appreciated that, with reference to the specification of priority application ZA2010/08925, the switching pressure and switching temperature may respectively be referred to as a triggering pressure and a triggering temperature.

When the switching signal is the shock signal of the shock tube, with the shock signal thus providing the light pulse, the shock tube may also include a photo-luminescent chemical or precursor therefor which provides the whole or a part of the light pulse. The photo-luminescent chemical may include, in particular, a fluorescent and/or a phosphorescent chemical or precursor therefor, or an oxide of a rare earth metal salt or precursor therefor.

Also, when the switching signal is a shock signal provided by shock tube as hereinbefore described, the shock signal may typically comprise three main signal components, including a detonation shock wave, a detonation product wave, and a detonation light pulse, all of which result from the progressive detonation of the explosive substance contained inside the shock tube. In such a case, the switching pressure may typically be provided by the shock wave, whilst the switching temperature may typically be provided by the detonation product wave and/or the detonation shock wave. The switching temperature may also possibly be provided by a debris wave that results from combustion of the explosive inside the shock tube and is thus propagated inside the shock tube. The switching light pulse will, of course, only be provided by the light pulse signal component. It will be appreciated that the shock wave, the product wave and the light pulse therefore each contributes perceivable or detectable properties to the shock signal, which properties the switching device is configured to detect.

When the switching property also comprises a switching pressure, the transistor may include a pressure sensitive material that is sensitive to the switching pressure as a function of its conductance, and with a pressure-activated change in the pressure sensitive material at the switching pressure resulting in an increase in the transistor conductance. The pressure sensitive material may, in particular, include a pressure sensitive rubber, constituting a layer of the transistor, and a pressure sensitive laminate, constituting an external laminate of the transistor.

When the switching property also comprises a switching temperature, thus in addition to the chemical compositional component and, possibly, also in addition to the switching pressure, the transistor may include a temperature sensitive material that is sensitive to the switching temperature as a function of its conductance, and with a thermally-activated change in the temperature sensitive material at the switching temperature resulting in an increase in the transistor conductance. The temperature sensitive material may typically be a polymeric ferroelectric material, such as a polyvinylidene fluoride (PDVF). In such a case the temperature sensitive material may be present in the transistor as a piezo- or pyroelectric polymer thin film capacitor that has thus been integrated with the transistor.

When the switching property also comprises a switching light pulse, thus in addition to the chemical compositional component and, possibly, also in addition to either or both of the switching pressure and the switching temperature, the transistor may include a photoconductive material that is sensitive to the switching light pulse as a function of its conductance, with a light pulse-activated change in the photosensitive material at the switching light pulse resulting in an increase in the transistor conductance. The transistor may, in particular, include an organic photovoltaic (OPV) cell that provides the photoconductive material.

In order to detect the switching chemical compositional component of the switching signal, the transistor may include a sensing material that is sensitive to the chemical compositional component as a function of its conductance, with a chemical reaction-activated change in the sensing material on exposure to the switching compositional component resulting in an increase in the transistor conductance. Typically, the sensing material may be a conducting polymer, or a conducting polymer that has been treated with or includes a material that may be regarded as the sensing material.

The chemical compositional component may, conveniently, be a combustion or detonation product of the explosive substance of the shock tube, e.g. HMX.

In one embodiment of the invention, the chemical compositional component may be carbon monoxide. In such a case, the sensing material may comprise polyaniline, tin oxide ($SnO_2$) doped with palladium (Pd), complexes of porphyrine, or a complex of phthalocyanine.

In another embodiment of the invention, the chemical composition component may, additionally or alternatively, be or include hydrogen cyanide (HCN) with the sensing material comprising polyaniline or a complex of porphyrine.

In yet another embodiment of the invention, the chemical compositional component may, alternatively or additionally, be $NO_x$. In such a case, the sensing material may be selected from or include polyaniline, poly(3-hexylthiophene), α-sexithiophene, a complex of porphyrine, a complex of phthalocyanine, or amorphous poly(triarylamine).

As indicated above also, the chemical compositional component may, alternatively or additionally, be a 'tracer' component or compound, i.e. not a combustion or detonation product of the shock tube explosive substance. In such a case, the sensing material may be sensitive to the tracer component or compound.

The transistor may, in particular, be an organic transistor, selected from an organic thin film transistor (OTFT) and an organic field effect transistor (OFET). Alternatively, the transistor may also be an inorganic transistor having an inorganic semiconductor component, e.g. silicon.

When the transistor is an organic transistor, the transistor may, in particular, be a printed organic transistor, that is printed onto a substrate which thus forms part of the initiating device. Printing the transistor onto the substrate may have been by means of ink-jet printing and/or screen printing.

For the purposes of consistency with the specification of the priority application(s), it is clarified that transduction of the switching or triggering property into a triggering signal, involves the variation in the conductance of the transistor on being exposed to the switching property. The triggering signal may therefore be regarded as the increase in conductance of the transistor, which allows for the voltage source to generate the detonation initiating voltage difference.

The voltage source may be an integrated voltage source, being integrated with the primary conductive path. In particular, the voltage source may comprise a chargeable or rechargeable component. Desirably, the chargeable or rechargeable component may be so chargeable or rechargeable on exposure to the switching property, as hereinbefore described, and dischargeable when the initiating device is in the standby condition.

In one embodiment of the invention, the integrated voltage source may be an integrated chargeable or rechargeable voltage source such as a battery or electrochemical cell. The battery may, in particular, be a printed or thin film battery, comprising organic components having been printed or laid onto a substrate that forms part of the detonator system, typically also carrying the initiating device and detonation circuitry. Preferably, the battery is chargeable or rechargeable on exposure to light, i.e. is photosensitive, particularly to the switching light pulse. The battery may therefore include or be operatively associated with or comprise charging components, such a photosensitive cell, such as an organic photovoltaic cell, or other photo-responsive component, such as a transistor, that is capable of charging the chargeable voltage source on exposure to the switching light pulse.

Alternatively, the integrated voltage source may be a passive voltage source, such as a capacitor. The capacitor may be then also be provided or operatively associated with charging components capable of stimulating build-up of charge inside the capacitor which charge, when discharged, will be sufficient to generate the detonation initiating voltage across the resistive bridge. The charging components may then, in particular, also include an organic photovoltaic cell, or other photo-responsive component, such as a transistor, that is capable of charging the chargeable voltage source on exposure to the switching light pulse.

It is to be appreciated that the voltage source therefore typically comprises a chargeable voltage source that is charged by a charging component operatively associated therewith. It is to be appreciated, however, that the voltage source can also be a component that is that is capable of being charged itself in response to the charging signal/property, and being capable itself to apply the detonation initiating voltage across the resistive bridge Thus, in use, electrical energy built up in the voltage source on exposure to the switching property is released once the conductance of the transistor is of a sufficient magnitude for the detonation initiating voltage to be generated across the resistive bridge by the, now charged, voltage source. It will be appreciated that through discharge of the charged chargeable component, the initiating device thus becomes switched into the detonation initiating condition.

In accordance with a second aspect of the invention, there is provided, in an explosives detonator system comprising an initiating device that is in a non-detonation initiating condition in which it cannot operatively accept a detonation initiating signal but which is capable, in a detonation initiating condition caused by operative acceptance of the detonation initiating signal, of causing initiation of an explosive charge with which the detonator system is, in use, arranged in a detonating relationship, a method of operating the detonator system which includes transmitting a switching signal having, as a switching property a chemical compositional component, to a switching device of the detonator system whilst the initiating device is in the non-detonation initiating condition; and switching the initiating device into a standby condition by means of the switching device on detection of the switching property of the switching signal, thereby rendering the detonator system susceptible to operative acceptance of the detonation initiating signal and thus susceptible to being switched into the detonation initiating condition.

The switching signal may include, in addition to the chemical compositional component, (i) a pressure component; (ii) a temperature component; and/or (iii) a light pulse. Any one or more of these may provide an additional switching property to the chemical compositional property.

The switching signal may, in particular, be a shock signal that is provided by and propagated along shock tube.

The shock tube may include a tracer chemical, with the proviso that the tracer chemical is not, and on combustion, detonation or decomposition does not provide, a chemical that is the same as a combustion or detonation product of the shock tube explosive. The tracer chemical may, in itself or through its decomposition, combustion or detonation, provide the chemical compositional component.

The shock tube may also include des a photo-luminescent material that provides the whole or a part of the light pulse. The photo-luminescent chemical may include, in particular, a fluorescent and/or a phosphorescent chemical.

The switching device may, in particular be a transistor having a variable conductance which, in the non-detonation initiating condition, provides resistance against conduction of current from the voltage source to the resistive bridge such that the detonation initiating voltage cannot, in use, be generated between the resistive electrodes, with switching of the initiating device into the standby condition including increasing the conductance of the transistor. It will therefore be appreciated that, on being switched into the standby condition, generation of the detonation initiating voltage between the electrodes becomes possible, with the initiating device therefore be susceptible to be being switched to the detonation initiating condition.

In accordance with a third aspect of the invention, there is provided a shock tube comprising an elongate body having a passage passing therethrough, in which passage is provided a shock tube explosive; and a tracer chemical; and/or a photo-luminescent chemical or precursor therefor, with the proviso that the tracer chemical is not, and on combustion, detonation or decomposition does not provide, a chemical that is the same as a combustion or detonation product of the shock tube explosive.

The photo-luminescent chemical may include a fluorescent and/or a phosphorescent chemical or a precursor therefor and may serve, in use, particularly to amplify, provide or adjust a light pulse provided by progressive detonation of the shock tube explosive along the length of the shock tube. When the photo-luminescent chemical is a precursor, it may, on combustion, detonation or decomposition thereof, become luminescent. The photo-luminescent chemical may, in one embodiment of the invention, be inorganic and comprise a rare earth metal salt or combinations of two or more such salts. Typically, the salts may be selected from oxide salts, nitrate salts, perchlorate salts, persulphate salts and combinations thereof. Alternatively, of course, the photo-luminescent chemical may be a precursor for such a salt or another luminescent oxide.

DETAILED DESCRIPTION OF THE INVENTION

The invention will now be described by way of illustrative example only with reference to the accompanying diagrammatic drawing which shows, conceptually, an explosive detonator system in accordance with the invention.

Referring to FIG. 1, reference numeral 10 generally indicates an explosives detonation system in accordance with the invention. The system 10 includes a detonator 11 having an initiating device 11*a*, a shock tube 13, and an explosive charge 15, with which the detonator 11, and thus the initiating device thereof, is arranged in a detonating relationship. The initiating device 11*a* is provided inside a housing 11*b* of the detonator 11.

The shock tube 13 is arranged in an initiating relationship with the detonator 11, such arrangement being represented conceptually by connecting line 17. In practice, the shock tube 13 will typically be physically connected to the detonator 11, e.g. by means of a clamp or, more preferably, by being inserted into an open end of the detonator 11 or housing thereof with the open end then being crimped about the shock tube, thereby to provide a seal.

The shock tube 13 is capable of generating and propagating there along a shock signal by reason of progressive detonation of an explosive substance provided therein. In one embodiment of the invention, the shock tube 13 may have a tracing substance or tracing chemical included in or mixed with the explosive substance, which tracing substance provides, on combustion thereof by reason of combustion of the explosive substance, a detectable chemical compositional property of a product wave of the shock signal. This possibility is described in more detail below. The detectable chemical compositional property may also be provided by a normal product of the explosive substance on combustion or detonation thereof. The explosive substance may, in particular, be HMX.

The detonator 11 is an electronic detonator by reason of the nature of its initiating device 11*a*. More particularly, the initiating device 11*a* comprises a voltage source 12 and a fuse head 14, both of which are located within the detonator housing 11*b*. The voltage source 12 and the fuse head 14 form part of a detonation circuit 16 comprising a primary conductive path 16.1, which typically comprises integrated or circuitry. In particular, the detonation circuit 16 as well as the fuse head 14, and thus the electrodes and resistive bridge thereof, may be printed circuitry, having been printed onto a substrate. Printing may have been achieved by any one or more of inkjet, gravure, screen printing, offset lithography, flexography and other reel to reel methods. The electrodes as well as resistive bridge may, in particular, be printed with a suitable polymeric or conductive ink, or metallization paste which is gold, copper, silver, carbon, stainless steels or aluminum based. When the paste is carbon-based, the carbon may particularly be in the form of nanotubes. The energy output from the resistive bridge could be enhanced by adding a layer printed in a suitable chemical (oxidizer, fuel and or explosive). The substrate may be PET, PEN, PI or coated paper.

As described hereinafter in more detail, the voltage source 12 may be integral with the initiating device 11*a*, i.e. may be located inside the detonator housing 11*b* and form part of the initiating device 11*a*. It is, however, expected that the voltage source may also be provided separately from the initiating device 11*a* and/or from the detonator 11. Thus, the voltage source 12 may be provided inside the detonator housing 11*b*, but not be integral with the initiating device. Further still, the voltage source may be provided outside the detonator housing 11*b*, e.g. being located remotely therefrom and then being connected to the detonator 11 and more particularly to the initiating device 11*a* by means of respective conducting elements or wires (not shown).

The fuse head 14 comprises two conductive electrodes 14.1*a*, 14.1*b* and a resistive bridge 14.2 which spans the electrodes. Respective poles 12.1, 12.2 of the voltage source 12 are operatively connected to the respective electrodes 14.1*a*, 14.1*b* of the fuse head 14 along the primary conductive path 16.1. The electrodes 14.1*a*, 14.1*b* may also be of a printed electronics nature, e.g. being printed by means of ink jet or screen printing.

The voltage source 12 is capable of generating a potential difference between the conductive electrodes 14.1*a*, 14.1*b* which exceeds a breakdown voltage of the resistive element 14.2. When this occurs, the resistive bridge 14.2 breaks down and generates a voltage spark or plasma which, in turn, generates a detonation signal in the form of a shock wave which is capable of initiating and, in fact, detonating or causing detonation of the explosive charge 15 with which the detonator 11 is arranged in a detonating relationship. Of course, in present invention, such initiation and detonation can only occur once the initiating device 11*a* has been switched into the standby condition in the manner hereinafter described.

A switching device 18 is provided in the primary conductive path 16.1, between one of the poles 12.1 of the voltage source 12 and one of the conductive electrodes 14.1*b* of the fuse head 14.

The switching device 18 comprises a transistor 18.1, particularly an organic thin film transistor (OTFT). The transistor 18.1 is capable of detecting, when present, a switching property a switching signal provided by the shock signal of the shock tube 13 and of switching the initiating device 11*a* to the standby condition on detecting the switching property. More particularly, the transistor 18.1 is capable of detecting a chemical compositional component which provides the switching property of the switching signal, the transistor 18.1 being sensitive to the chemical compositional property as a function of its conductance such that its conductance increases on exposure to the switching property. As indicated hereinbefore, the chemical compositional component may include a tracing chemical, being provided in the shock tube 13 particularly for providing the chemical compositional component (as explained in more detail below) and/or a normal combustion or detonation product of the shock tube explosive.

In particular, in order to detect the chemical compositional component, the transistor 18.1 includes a sensing material that is sensitive, in a chemically reactive sense, to the chemical compositional component as a function of its conductance, with a chemical reaction-activated change in the sensing material on exposure to the switching compositional component resulting in an increase in the transistor conductance. Typically, the sensing material is a conducting polymer, or a conducting polymer that has been treated with or includes a material that may be regarded as the sensing material.

In one embodiment of the invention, the chemical compositional component is carbon monoxide. In such a case, the sensing material includes polyaniline, tin oxide ($SnO_2$) doped with palladium (Pd), complexes of porphyrine, and/or a complex of phthalocyanine.

In another embodiment of the invention, the chemical composition component, additionally or alternatively, is or includes hydrogen cyanide (HCN), with the sensing material comprising polyaniline or a complex of porphyrine.

In yet another embodiment of the invention, the chemical compositional component, alternatively or additionally, is or includes $NO_x$. In such a case, the sensing material is selected from or includes polyaniline, poly(3-hexylthiophene), α-sexithiophene, a complex of porphyrine, a complex of phthalocyanine, or amorphous poly(triarylamine).

The capability of the transistor 18.1 to detect the chemical compositional component and to switch the initiating device 11*b* from the non-detonation initiating condition to the standby condition, is by reason of a variable conductance thereof. The transistor 18.1 therefore has a variable conductance. In the non-detonation initiating condition, the conductance of the transistor 18.1 is non-conducive to the conduction of current from the voltage source 12 along the conductive path 16.1 to the electrodes 14.1*a*, 14.1*b* of the fuse head 14 in order for the detonation initiating voltage to be generated across the resistive bridge 14.2. Thus, the transistor 18.1 prevents generation of the detonation initiating voltage difference between the electrodes. In contrast, in the standby condition, the conductance of the transistor is conducive to the conduction of current from the voltage source 12 along the conductive path 16.1 to the electrodes 14.1*a*, 14.1*b* of the fuse head 14 and thus also to the generation of the detonation initiating voltage.

In each of the embodiments of chemical compositional component hereinbefore mentioned, the sensing material of the transistor 18.1 initially has a conductance that is non-conducive to the conduction of current from the voltage source 12 to the fuse head 14 in order for the detonation initiating voltage to be generated across the resistive bridge 14.2. It will be appreciated that this situation provides the non-detonation initiating condition, in that even if the voltage source 12 is active, the detonation initiating voltage cannot be generated across the resistive bridge 14.2 and the resistive bridge 14.2 can thus not be broken down in order to provide the detonation signal. However, being chemically reactively sensitive to the respective chemical compositional components as a function of conductance, exposure of the respective sensing materials to the appropriate chemical compositional component results in an increase in that material's conductance. Thus, on exposure to the switching property, it becomes possible for the voltage source 12 to generate the detonation initiating voltage across the resistive bridge 14.2, with the initiating device 11*a* thus being switched to the standby condition, in which it awaits an electrical detonating signal, in the form of the detonation initiating voltage, in order to initiate the explosive charge 15.

The transistor 18.1 may also, in certain embodiments of the invention, be capable of detecting any one or more of pressure, temperature and light. This is particularly the case when the switching signal has, in addition to the chemical compositional component, a pressure component, a temperature component, and a light pulse, as is generally the case for shock tube. Each of these may respectively provide a switching pressure, a switching temperature, and a switching light pulse, with the transistor 18.1 then being capable of detecting each of these and, possibly, of switching the initiating device 11*a* to the standby condition, typically in the manner hereinafter described.

The capability of the transistor 18.1 to detect the switching pressure, switching temperature, and switching light pulse, may also be by reason of the variable conductance thereof, similarly to the capability of the transistor 18.1 to detect the chemical compositional component, in the manner hereinbefore described.

When the switching property also comprises a switching pressure, the transistor 18.1 includes a pressure sensitive material that is sensitive to the switching pressure as a function of its conductance, and with a pressure-activated change in the pressure sensitive material at the switching pressure resulting in an increase in the transistor conductance. The pressure sensitive material can, in particular, include a pressure sensitive rubber, in which case it typically constitutes a layer of the transistor, and a pressure sensitive laminate, in which case it typically constitutes an external laminate of the transistor.

The transistor 18.1 may thus typically comprise an integration of an organic thin film transistor (OTFT) with the pressure sensitive material. The pressure sensitive material may, in particular, have a variable resistance that is a function of its mechanical deformation, thus imparting a change in conductivity to the OTFT at the switching pressure that is sufficient for the conductivity to be conducive to the generation of the detonation initiating voltage. One example of such a material is pressure sensitive rubber that contains carbon particles and a silicon rubber matrix. Another example of a device utilising pressure sensitive rubber for pressure detection is one based of space-charge limited transistors (SCLT), having P3HT as an active layer. A SCLT is a vertical transistor with a grid electrode inserted between source electrode and drain electrode to control the vertical current flow. As pressure is applied to the pressure sensitive rubber the resistance and therefore current in the source-drain circuit is systematically changed allowing the applied pressure to be monitored. Another possibility is the employment of a flexible pressure sensor, possibly through employment of transparent plastic foil as both the substrate and gate dielectric of the transistor 18.1. When the pressure sensitive material comprises a laminate, the laminate may typically be a polydimethylsiloxane (PDMS) mold with gold electrodes. It is to be noted, however, that OTFT's have an inherent sensitivity to applied pressure, for example pentacene transistors having a solution-processed polyvinylphenol gate dielectric on a glass substrate.

When the switching property also comprises a switching temperature, thus in addition to the chemical compositional component and, possibly, also in addition to the switching pressure, the transistor includes a temperature sensitive material that is sensitive to the switching temperature as a function of its conductance, and with a thermally-activated change in the temperature sensitive material at the switching temperature resulting in an increase in the transistor conductance. The temperature sensitive material is typically a polymeric ferroelectric material, preferably a polyvinylidene fluoride (PDVF). In such a case the temperature sensitive material is present in the transistor as a piezo- or pyroelectric polymer thin film capacitor that has thus been integrated with the transistor.

When the switching property also comprises a switching light pulse, thus in addition to the chemical compositional component and, possibly, also in addition to either or both of the switching pressure and the switching temperature, the transistor 18.1 includes a photoconductive material that is sensitive to the switching light pulse as a function of its conductance, with a light pulse-activated change in the photosensitive material at the switching light pulse resulting in an increase in the transistor conductance. The transistor 18.1 may, in particular, include an organic photovoltaic (OPV) cell that provides the photoconductive material.

Detectors for light pulses usually fall into two broad categories, namely (i) devices which integrate together an organic photovoltaic (OPV) cell and an OTFT, using the photoresponse of the OPV device to modify the output of the OTFT whilst taking advantage of the amplification inherent to the transistor, and (ii) devices which use the inherent photoconductivity of conducting polymers or blends of conducting polymers and complimentary electron donor or acceptor molecules in the OTFT. Both approaches rely on the formation and charge separation of excited states within the OTFT upon exposure to incident light. One example of the first type of device is a large-area, flexible, and lightweight photodetectors, also referred to as sheet-type image scanners, which are fabricated on plastic film using integrated OTFTs and organic photodiodes. Another example, is organic photosensors (OPS's) that are integrated a pentacene-based OTFT with a traditional P3HT:PCBM bulk heterojunction OPV device. This type of OTFT-based light detector is particularly attractive in that the current obtained from the OPV component could conceivably be used to power a secondary circuit to, for example, time and detonate a primary explosive charge. It could also, conceivably, act as voltage source for generating the detonation initiating voltage. Furthermore, given the wide range of materials which can be used in OPV devices, tailoring to a given spectrum of light (such as from shock tube emission or a shock tube light pulse) can be achieved.

Examples of the second type of OTFT optical sensor, those which use the photoconductivity of conducting polymers, are based thereon that the inherent photoconductivity of all organic semiconductors implies that all OTFTs based upon these materials must show some degree of photoresponse. However, there are known to be difficulties associated with the photoresponse of organic semiconductors, in particular, inefficient dissociation of the photogenerated excitons into free carriers and the long transit times due to poor carrier mobilities. To overcome these issues the group there has been proposed an ultra-thin multilayer structure, in which the photodetector active region consists of 64 alternating layers, varying in thickness, ranging from 10 to 160 Å for each layer, of, inter alia, Cu phthalocyanine (CuPc) (electron donator) and 3,4,9,10-perylenetetracarboxylic bis-benzimidazole (PTCBI) (electron acceptor) grown by ultra-high vacuum organic molecular-beam deposition.

Low-voltage ambipolar organic phototransistors based on a pentacene/[6,6]-phenyl-C61-butyric acid methyl ester (PC61BM) bilayer as the semiconducting layer with a self-assembled monolayer as the gate dielectric are also a possibility. Such transistors have been shown to operate below |3| V with electron and hole mobilities on the order of 0.1 and 10-3 cm2/Vs, respectively. Importantly, the channel current of such transistors are dependent not only on biasing conditions, but also on intensity of incident light, allowing the device to be used as an optical sensor. The external quantum efficiency and response time of these low-power phototransistors can be ~0.8% and 210-225 ms, respectively.

Finally, in regard to light sensitivity, covalently bound organic donor/acceptor dyads can be used to enhance charge separation, and thus signal response, in photoconductive materials for optical detectors. Highly responsive UV-sensitive field-effect transistors based on amorphous thin films of such an organic dyad are known in literature. Such devices are associated with an optimal responsivity of up to 6.5 A/W for UV light at 370 nm. The underlying mechanism is postulated at the hand of ultrafast photoinduced intramolecular charge transfers between the acceptor and the donor, leading to more facile intermolecular charge transfer. This result offers a potential application of organic semiconductors as active materials for UV detectors.

It is to be noted, importantly, that the switching device 18 can, possibly, include a plurality of transistors, each being configured for the detection of a respective switching property of the switching signal. Of course, in accordance with the invention, the switching device 18 will always include a transistor capable of detecting the chemical compositional component. It will be appreciated that, if the switching device 18 comprises a plurality of transistors, each transistor will, in itself, provide a resistance to current that may attempt to pass to the fuse head 14. In order for such current to be allowed to pass, it will therefore be necessary, on detection of each of their respective switching properties, for the conductance of each transistor to increase sufficiently for the detonation initiating voltage to be generated across the resistive bridge 14.2. Thus, for the standby condition to be assumed by the initiating device 11*a* in such a case, it is necessary for all of the switching properties associated with the respective transistors to be present in the switching signal. It will be appreciated that such a situation therefore provides for multiple detection modes being required from the switching device 18.

In a particular embodiment of the invention, and as alluded to hereinabove, the voltage source 12 may be an integrated voltage source, being integrated with the primary conductive path 16.1.

The voltage source 12 may also, in particular, be in the form of a chargeable or rechargeable voltage source. In such a case, the voltage source 12 may comprise or be operatively associated with a charging component that is capable, on exposure to the switching property, of charging the voltage source 12 and thus rendering it dischargeable when the initiating device 11*a* is in the standby condition, thereby to apply the detonation initiating voltage across the resistive bridge 14.2.

Such a charging component may typically be or include a photosensitive cell, such as an organic photovoltaic cell, or other photo-responsive component, such as a transistor.

Alternatively, the charging component itself may be the voltage source 12. Thus, in accordance with the invention, the charging component may also form or form part of the voltage source 12, particularly when the voltage source 12 is a battery that is chargeable or rechargeable, e.g. including a photosensitive material, possible forming part of a photovoltaic cell that is included in the battery.

Thus, electrical energy built up in the voltage source 12 on exposure to the switching property is then released once the conductance of the transistor 18.1 is of a sufficient magnitude for the detonation initiating voltage to be generated across the resistive bridge 14.2 by the, now charged, voltage source 12, i.e. in the standby condition. It will be appreciated that through discharge of the charged voltage source, the initiating device 11*a* thus becomes switched from the standby condition into the detonation initiating condition.

The charging component may be charged by any one or more of the switching properties described hereinbefore and not necessarily only by the chemical compositional component. Preferably, the charging component is capable of being charged and thus of charging the voltage source by a switching property that moves faster than the other switching properties, e.g. light. Thus, the charging component may charge the voltage source 12 prior to switching of the initiating device 11*a* into the standby condition. The charging component may therefore typically be a photosensitive transistor, a photodiode or other photosensitive device. In such a case, the shock tube 13 may, in particular, include a photo-luminescent additive that enhances, extends or increases the light energy output of an explosive substance carried inside the shock tube 13. Such a photo-luminescent additive may include either or both of fluorescent and/or phosphorescent organic or inorganic materials that increase or modify the wavelength of the emitted light pulse or otherwise alter the optical emission properties of the shock tube 13 so as to enhance the light (energy) that is emitted from the shock tube 13 for photovoltaic applications.

It is expected that such a configuration of the present invention is particularly advantageous in that the voltage source 12 is, in effect, powered by the same shock signal that switches the initiating device 11*a* into the standby condition. Initiating of the explosive can then be rendered fully dependent on a shock signal having very specific switching properties.

It is to be appreciated that application of the detonation initiating voltage would not necessarily lead immediately to detonation of the explosive charge. In this regard, the initiating device 11*a* may have incorporated therein timing and delay components that are powered by application of the detonation initiating voltage and then, in turn, cause detonation of the explosive.

In use, the transistor 18.1 of the switching device 18 will initially, i.e. at manufacture most likely, have a conductance of magnitude insufficient for conducting sufficient current from the voltage source 12, of predetermined load, for the voltage source 12 to generate the detonation initiating voltage across the resistive bridge 14.2. The initiating device 11*a* is thus initially in the non-detonation initiating condition. The transistor 18.1 will, however, be configured in the manner hereinbefore described and thus be capable of detecting, as a function of its conductance, a switching property of a switching signal transmitted by the shock tube 13, such a switching property being at least a chemical compositional component of the switching signal and, optionally, also any one or more of a switching pressure, a switching temperature and a switching light pulse. The detonator 11, with the initiating device 11*a* and the transistor 18.1, is then positioned in a detonating relationship relative to the explosive charge 15. The shock tube 13, being capable of transmitting a shock signal having a product wave including the chemical compositional component and, if applicable, the switching pressure, the switching temperature and the switching light pulse, is then connected to, or at least provided in an initiating relationship relative to, the detonator 11.

Once detonation of the explosive charge 15 is to occur, the shock tube 13 is initiated remotely from the detonator 11, with the shock signal then being propagated there along. Once the shock signal is in proximity to the initiating device 11*a*, sufficiently so that the switching property/properties thereof are detected by the transistor/s 18.1, the conductance of the transistor/s 18.1 thus increases sufficiently to allow for the detonation initiating voltage to be generated by the voltage source 12 across the resistive bridge 14.2, with the initiating device 11*a* thus being switched to the standby condition. With the conductance of the transistor/s 18.1 having thus increased, the initiating device 11*a* has become susceptible to receiving and conducting, along the primary conductive path 16.1, sufficient current from the voltage source 12 for the *detonation initiating voltage to be generated by the voltage source 12 across the resistive bridge 14.2. Activation of the voltage source 12 therefore switches the initiating device 11*a* to the detonation initiating condition in which the detonation initiating voltage is applied across the resistive bridge 14.2, which results in breakdown of the resistive bridge 14.2 and generation a spark or plasma, emitting a detonation initiating shock wave that initiates the explosive charge 15.

In a particular embodiment of the invention, the shock tube 13 may be a shock tube in accordance with the invention, having a hollow, elongate body, inside which a shock tube explosive is contained. The shock tube explosive is, in particular, HMX, as also indicated above. The shock signal hereinbefore referred to is thus provided by progressive detonation of the HMX. Other explosive substances, associated with shock tube, can, of course, also be employed as shock tube explosive.

As indicated above, the shock tube 13 also, preferably, includes a tracer chemical and, optionally, a photo-luminescent chemical.

The tracer chemical is, in particular, a chemical that is not, or on combustion, detonation or decomposition does not provide, a chemical that is the same as a detonation or combustion product of the shock tube explosive.

When present in the shock tube 13, the tracer chemical provides the chemical compositional component, either in itself or by way of combustion, detonation or decomposition product thereof. The presence of the tracer chemical is, in such a case, therefore a prerequisite for the initiating device to be switched from the non-detonation initiating condition into the standby condition.

In a particular embodiment of the invention, the tracer chemical is a gas-generating chemical.

The photo-luminescent chemical may particularly include a fluorescent and/or a phosphorescent chemical or a precursor for such a chemical or for another luminescent chemical.

The photo-luminescent chemical serves, in use, particularly to enhance, amplify and/or adjust, i.e. impart particular properties of wavelength and/or intensity to, the light pulse component of the shock signal of the shock tube. The photo-luminescent chemical may therefore be selected particularly for compatibility with a particular photosensitive material of the transistor 18.1 and/or of the chargeable component of the voltage source 12. In the case of the voltage source 12, the photo-luminescent chemical is preferably selected for generating a photo-response from the voltage source 12 that is sufficient for the voltage source 12 to generate the detonation initiating voltage difference across the electrodes 14.1*a*, 14.1*b*.

The photo-luminescent chemical may in particular, be inorganic and may comprise a rare earth metal salt or combinations of two or more such salts. Typically, the salts may be selected from oxide salts, nitrate salts, perchlorate salts, persulphate salts and combinations thereof. Alternatively, of course, the photo-luminescent chemical may be a precursor for such a salt or another luminescent oxide.

The present invention therefore envisages a detonation system, such as the detonation system 10, that is capable of being switched from a non-detonation initiating condition, in which it cannot operatively accept a detonation initiating signal, to a standby condition, in which it can operatively accept the detonation initiating signal, with such switching being effected by means of a switching device that comprises a transistor which is capable switching the initiating device from the non-detonation initiating condition to the standby condition on detection of at least a chemical compositional component of a switching signal that comprises a shock signal transmitted by shock tube.

The Applicant believes that an approach to detonator system operation as is described herein, i.e. by rendering an initiating device susceptible to initiation only under predetermined conditions, will be particularly beneficial to operational safety of such detonator systems, as inadvertent detonation caused by premature detonation initiating signal transmission will be prevented. The present invention therefore requires operation of a detonator system to proceed along a particular chain of events in order for detonation to result.

In particular, the Applicant believes that the employment of multiple detection modes, including at least a detection mode for a chemical compositional component of the switching or shock signal, in a switching device employed in a detonator system according to the invention renders a particular improvement in the operational safety of detonator systems. This is by reason thereof that, whereas signal components of pressure, temperature and light are not readily susceptible to accurate control for the purposes of providing narrow predetermined signals, chemical composition can, to a certain extent at least, be controlled, e.g. by including a particular compositional component in the explosive contained by the shock tube with which the system is to be employed.

The important feature of the present invention of chemical compositional component detection is therefore regarded as imparting particular advantages of improved control and safety to the present invention.

Additionally, the present invention envisages an enhanced shock tube that contains, in addition to a shock tube explosive thereof, a tracer chemical and, optionally, a photo-luminescent chemical. It is believed by the Applicant that such additives will aid in expanding the functionality of shock tube to more limited compatibility with detonators tailored therefor and also render the shock tube useful in managing safety of explosive and detonator systems, such as the system of the present invention.

The invention claimed is:

1. An explosives detonator system for detonating an explosive charge with which it is, in use, arranged in a detonating relationship and which, on operative acceptance of a detonation initiating signal that has a detonation initiating property, is capable of initiating and thus detonating the explosive charge, the detonator system including an initiating device which is capable of accepting the detonation initiating signal and of initiating and thus detonating the explosive charge, the initiating device being in a non-detonation initiating condition in which it cannot operatively accept the detonation initiating signal and thus assume a detonator initiating condition when the detonation initiating signal is transmitted thereto; and a switching device that is capable of detecting a chemical compositional component as a switching property of a switching signal that is transmitted to the detonator system, with the switching device being capable of switching the initiating device, on detection of the chemical compositional component, to a standby condition in which the initiating device is capable of operatively accepting the detonation initiating signal when it is transmitted thereto.

2. The detonator system according to claim 1, which includes a shock tube that is provided in initiating proximity to the initiating device and the switching signal is a shock signal which is provided by, and propagated along, the shock tube.

3. The detonator system according to claim 2, in which the shock tube has a hollow elongate body, inside of which is provided a shock tube explosive, detonation of which provides the shock signal; and a tracer chemical, with the proviso that the tracer chemical is not, and on decomposition, detonation or combustion thereof does not provide, a chemical that is the same as a combustion or detonation product of the shock tube explosive.

4. The detonator system according to claim 3, in which the tracer chemical provides the chemical compositional component.

5. The detonator system according to claim 2, in which the initiating device comprises an electronic detonation circuit which includes a primary conductive path having at least two spaced apart conductive electrodes between which a resistive bridge is provided, the electrodes being connectable to a voltage source which, when the initiating device is in the standby condition, is capable of generating a detonation initiating voltage difference, as the detonation initiating property, between the electrodes, which voltage difference exceeds the breakdown voltage of the resistive bridge, thereby, in use in the detonation initiating condition, to cause the resistive bridge to generate a voltage spark or plasma capable of causing initiation and detonation of the explosive charge.

6. The detonator system, according to claim 5, in which the switching device is a resistive component that is provided in the primary conductive path of the detonation circuit and provides resistance against conduction of current from the voltage source to the resistive bridge in the non-detonation initiating condition, such resistance being of sufficient magnitude that the detonation initiating voltage cannot, in use, be generated between the resistive electrodes.

7. The detonator system according to claim 6, in which the switching device has a variable conductance, with its conductance, in the non-detonation initiating condition, being of a magnitude that is non-conducive to generation of the detonation initiating voltage difference between the electrodes.

8. The detonator system according to claim 7, in which the conductance of the switching device is sensitive to, and thus capable of being changed, in response to the chemical compositional component of the switching signal such that, in the standby condition, the conductance of the switching device is of a magnitude that is conducive to generation of the detonation initiating voltage difference between the electrodes.

9. The detonator system according to claim 8, in which the switching device is a transistor.

10. The detonator system according to claim 9, in which the switching property also comprises a switching pressure, with the transistor including a pressure sensitive material that is sensitive to the switching pressure as a function of its conductance, and with a pressure-activated change in the pressure sensitive material at the switching pressure resulting in an increase in the transistor conductance.

11. The detonator system according to claim 10, in which the pressure sensitive material includes a pressure sensitive rubber, constituting a layer of the transistor, and a pressure sensitive laminate, constituting an external laminate of the transistor.

12. The detonator system according to claim 9, in which the switching property also comprises a switching temperature, with the transistor including a temperature sensitive material that is sensitive to the switching temperature as a function of its conductance, and with a thermally-activated change in the temperature sensitive material at the switching temperature resulting in an increase in the transistor conductance.

13. The detonator system according to claim 12, in which the temperature sensitive material is polyvinylidene fluoride (PVDF).

14. The detonator system according to claim 9, in which the switching property also comprises a switching light pulse, with the transistor including a photoconductive material that is sensitive to the switching light pulse as a function of its conductance, and with a light pulse-activated change in the photosensitive material at the switching light pulse resulting in an increase in the transistor conductance.

15. The detonator system according to claim 14, in which the transistor includes an organic photovoltaic (OPV) cell that provides the photoconductive material.

16. The detonator system according to claim 9, in which the transistor includes a sensing material that is sensitive to the chemical compositional component as a function of its conductance, with a chemical reaction-activated change in the sensing material on exposure to the chemical compositional component resulting in an increase in the transistor conductance.

17. The detonator system according to claim 16, in which the chemical compositional component is carbon monoxide, and wherein the sensing material comprises polyaniline, tin oxide ($SnO_2$) doped with palladium (Pd), complexes of porphyrine, or a complex of phthalocyanine.

18. The detonator system according to claim 16, in which the chemical compositional component is, or includes, hydrogen cyanide (HCN), and wherein the sensing material comprises polyaniline or a complex of porphyrine.

19. The detonator system according to claim 16, in which the chemical compositional component is, or includes, $NO_x$, and wherein the sensing material comprises polyaniline, poly (3-hexylthiophene), α-sexithiophene, a complex of porphyrine, a complex of phthalocyanine, or amorphous poly(triarylamine).

20. The detonator system according to claim 9, in which the transistor is an organic thin film transistor (OTFT) or an organic field effect transistor (OFET).

21. The detonator system according to claim 20, in which the organic transistor is a printed organic transistor that is printed onto a substrate, with the substrate thus being included in the initiating device.

22. The detonator system according to claim 5, in which the voltage source is an integrated voltage source, being integrated with the primary conductive path.

23. The detonator according to claim 5, in which the voltage source comprises a charging component that is capable of charging the voltage source on exposure to the switching property, thus rendering the voltage source ready for discharge when the initiating device is in the standby condition.

24. The detonator system according to claim 1, in which the switching signal includes:

(i) a pressure component;

(ii) a temperature component; and/or (ii) a light pulse, with the switching signal thus providing, as a switching property additional to the chemical compositional component, a switching pressure, a switching temperature, and/or a switching light pulse, and with the switching device thus also being capable of detecting the switching pressure, the switching temperature and/or the switching light pulse and of switching the initiating device to the standby condition on detection thereof.

25. The detonator according to claim 24, which includes shock tube that is provided in initiating proximity to the initiating device and the switching signal is a shock signal which is provided by, and propagated along, the shock tube; and in which the shock tube also includes a photo-luminescent chemical which provides the whole or a part of the light pulse.

26. The detonator according to claim 25, in which the photo-luminescent chemical includes a fluorescent and/or a phosphorescent chemical.

27. In an explosives detonator system comprising an initiating device that is in a non-detonation initiating condition in which it cannot operatively accept a detonation initiating signal but which is capable, in a detonation initiating condition caused by operative acceptance of the detonation initiating signal, of causing initiation of an explosive charge with which the detonator system is, in use, arranged in a detonating relationship, a method of operating the detonator system which includes transmitting a switching signal having, as a switching property a chemical compositional component, to a switching device of the detonator system whilst the initiating device is in the non-detonation initiating condition; and switching the initiating device into a standby condition by means of the switching device on detection of the switching property of the switching signal, thereby rendering the detonator system susceptible to operative acceptance of the detonation initiating signal and thus susceptible to being switched into the detonation initiating condition.

28. The method according to claim 27, wherein the switching signal includes, in addition to the chemical compositional component, (i) a pressure component;

(ii) a temperature component; and/or (ii) a light pulse, as an additional switching property.

29. The method according to claim 28, wherein the switching signal is a shock signal that is provided by, and propagated along, shock tube; and wherein the shock tube includes a photo-luminescent material that provides the whole or a part of the light pulse.

30. The method according to claim 29, in which the photo-luminescent chemical includes a fluorescent and/or a phosphorescent chemical.

31. The method according to claim 27, wherein the switching signal is a shock signal that is provided by, and propagated along, shock tube.

32. The method according to claim 31, wherein the shock tube includes a tracer chemical, with the proviso that the tracer chemical is not, and on combustion does not provide, a chemical that is the same as a combustion or detonation product of the shock tube explosive.

33. The method according to claim 32, wherein the tracer chemical provides the chemical compositional component.

34. The method according to claim 27, wherein the initiating device comprises an electronic detonation circuit which includes a primary conductive path having at least two spaced apart conductive electrodes which are connected to a voltage source and between which a resistive bridge is provided, with switching the initiating device into the detonation initiating condition when the initiating device is in the standby condition includes applying as the detonation initiating property of the detonation initiating signal a voltage difference over the electrodes that exceeds the breakdown voltage of the resistive bridge, causing the resistive bridge to generate a voltage spark or plasma that causes initiation and detonation of the explosive charge.

35. The method of according to claim 34, wherein the switching device is a transistor with variable conductance which, in the non-detonation initiating condition, provides resistance against conduction of current from the voltage source to the resistive bridge such that the detonation initiating voltage cannot, in use, be generated between the resistive electrodes, with switching of the initiating device into the standby condition including increasing the conductance of the transistor.

* * * * *